United States Patent [19]

Romagnoli

[11] Patent Number: 4,828,851

[45] Date of Patent: May 9, 1989

[54] FILTER BAG FOR INFUSIBLE PRODUCTS

[75] Inventor: Andrea Romagnoli, San Lazzaro di Savena, Italy

[73] Assignee: Cestind—Centro Studi Industriali—S.R.L., Bologna, Italy

[21] Appl. No.: 107,885

[22] Filed: Oct. 9, 1987

Related U.S. Application Data

[63] Continuation of Ser. No. 823,582, Jan. 29, 1986.

[30] Foreign Application Priority Data

Feb. 8, 1985 [IT] Italy ..... 3328 A/85

[51] Int. Cl.[4] ..... B65B 29/04

[52] U.S. Cl. ..... 426/79; 206/0.5; 426/83; 426/110; 426/119; 383/38

[58] Field of Search ..... 426/77–84, 426/119, 110, 394, 112, 115; 206/0.5; 99/295, 321, 323; 383/38

[56] References Cited

U.S. PATENT DOCUMENTS

| | | | |
|---|---|---|---|
| 2,213,602 | 9/1940 | Yates | 426/394 |
| 2,357,339 | 9/1944 | Mathieu | 206/602 |
| 2,362,460 | 11/1944 | Barnett | 426/82 |
| 2,593,608 | 4/1952 | Rambold | 426/79 |
| 2,791,505 | 5/1957 | Barnett | 426/79 |
| 2,793,120 | 5/1957 | Bennett | 426/79 |
| 2,794,745 | 6/1957 | Vergobbi | 426/83 |
| 2,878,927 | 3/1959 | Haley | 426/83 |
| 2,891,867 | 6/1959 | Irmscher | 426/83 |
| 2,908,383 | 10/1959 | Vogt | 206/602 |
| 2,925,171 | 2/1960 | Eaton | 426/83 |
| 2,954,294 | 9/1960 | Whelan | 426/79 |
| 3,053,665 | 9/1962 | Irmscher | 426/83 |
| 3,223,229 | 12/1965 | Welin-Berger | 426/83 |
| 3,692,536 | 9/1972 | Fant | 426/77 |
| 4,055,668 | 10/1977 | Kopp | 426/79 |

FOREIGN PATENT DOCUMENTS

| | | | |
|---|---|---|---|
| 1134626 | 8/1962 | Fed. Rep. of Germany | 426/79 |
| 2500100 | 6/1976 | Fed. Rep. of Germany | 426/79 |
| 919409 | 2/1963 | United Kingdom . | |
| 962038 | 6/1964 | United Kingdom | 426/79 |
| 1157513 | 7/1969 | United Kingdom . | |

*Primary Examiner*—Steven Weinstein
*Attorney, Agent, or Firm*—Herbert Dubno

[57] ABSTRACT

A filter bag for insusion products is provided having multiple successive container pockets or lobes, each for infusing a corresponding dose or unit quantity of product. The bag structure permits two usage layouts. The flat layout form is for packaging in lots for sale with said lobes superimposed or folded one over the other or side by side. The other layout form has the lobes opened out or distended following the pick up and pull of the corresponding tag (label) ending in the thread for handling the filter bag at the time of usage. The thread has a length equal to that of the bag as laid out for use with the pockets or lobes distended. The thread is fixed to the opposing ends of said bag by means of a piece of heat weldable material together with the non heat weldable paper tag (label) adjacent to one of said opposing ends. Additionally the thread is wrapped lengthwise externally to the bag when said pockets or lobes are in their position of usage and packaged in lots for sale with back-to-back folded lobes.

1 Claim, 2 Drawing Sheets

FILTER BAG FOR INFUSIBLE PRODUCTS

This is a continuation of co-pending appliction Ser. No. 823,582 filed on Jan. 29, 1986.

DESCRIPTION

The present invention concerns a twice usable filter bag for infusion products and a method for manufacturing it.

In making infusions it is well known that the increase in the contact surface between the liquid and the infusion product particles in the form of grindings speeds up the infusion process. Moreover, an increased contact surface enables better utilization of the product i.e., one obtains a greater unit utilization of the same infusion product.

The use of filter paper bags is well known with respect to traditional infusions such as those with tea and camomile grindings. So-called tea, camomile etc. bags, have a unit capacity which unit to be soaked at the time of consumption of the infusion in a suitable container with boiling water.

At present, in the particular case of tea infusions three main types of filter bag structures are known which do not allow the dose or unit quantity of grindings to grow in volume and dissolve upon immersion of the filter bag in the water and then the water to flow all around the tea particles.

A first traditional type of filter bag structure is that comprising the filter bag made in a very simple manner with two layers of filter paper placed face-to-face or superimposed and welded at least along three, or all of the four sides.

The aforesaid filter bag structure creates an extremely flat filter bag, therefore theoretically without a capacitative volume, which on immersion in the water holds compactly the tea grindings. This is in clear contrast with the fundamental requirement expressed above of a volume growth and dissolution of the product in order to accelerate the infusion process and obtain a greater unit utilization of the product itself.

A second traditional filter bag structure intended to improve performance from the point of view of volume growth and speeding up of the infusion process as well as a greater utilization of the infusion product envisages, in a structure similar to the fundamentally flat one with two layers of face-to-face and superimposed layers of filter paper, a number of folds along at least two opposing sides, bellows-like.

In practice, it has been found that these folds in a container filter bag for a given unit quantity of infusion product enable an expansion of its capacity volume just sufficient to allow a partial swelling of the product when immersed in the water, and not due to the dissolution of the product in order to allow the water to flow freely through its particles.

A third typical traditional filter bag structure, always intended to improve the performance from the volume growth standpoint, the speeding up of the infusion process and the greater utilization of the infusion product, envisages a filter bag with two or more sections or lobes for containing the product, with or without the lateral bellow-like folds.

In reality these filter bags with multiple container sections or lobes have effectively increased the containing volume with the same unit content. Unfortunately the sections or lobes are densely packed one against the other, with little possibility of opening out at the bottom, and none in upper area. Allowing the swelling, the product is pressed against the walls of each individual lobe with reciprocal contact with the walls of the next lobe, particularly in the upper area, with little possibility for the water to flow between the particles of the product thus compressed.

Still with the intention of improving volume growth performance of speeding the infusion process and greater utilizing the infusion product, more recently a filter bag has been proposed that would assume two stable positions. One is a flat position for storage and for packaging in lots for sale. The other position is for three-dimensional use. The internal volume is here decidely greater than in prior art filter bags having the same amount of material but having the infusion product particles in the lower area of the bag still compressed following the swelling during infusion.

The practical embodiment of such a three-dimensional filter bag is furthermore problematic both from the point of view of production capacity ready from that of the automatic manufacturing machine, and consequently also from the standpoint of production costs.

Traditionally, the upper terminal section of these known filter bags is shaped with a polygonal profile generally of a trapezoidal development, or even triangular. A thread is departably attached to the upper terminal section and always anchored and bearing a tag (label) forming the pick-up element for the handling of the filter bag during use. The main aim of this invention is to provide a filter bag for the use indicated above, able to ensure volume growth and dissolution of the dose or unit quantity of tea upon immersion in water and then the flow of the water around the tea particles through a filter bag structure with multiple pockets or lobes, either successive or in series, each containing a corresponding fraction of said dose or unit quantity of tea and such as to be able to assume two positions in use: one in substantially flat form for packaging in lots for sale, with said successive pockets or lobes superimposed or back-to-back (face-to-face) with a pocket or lobe folded over or next to the other, and the other with a layout of pockets or lobes opened out or distended, either one after the other or in series.

Another aim of the present invention is to provide a filter bag where the thread ending in the tag (label) for the handling of the filter bag when in use is fixed to the opposing ends of the bag and is longitudinally wrapped externally on it when its pockets or lobes, successive or in series, are in their position of use and packaging in lots for sale with the lobes folded and back-to-back (face-to-face).

A further aim of the present invention is to provide a filter bag such that the fixing of the thread at the opposing ends of the bag with the appropriate tag (label) is localized to said opposing ends for heat welding purposes.

A further aim of this invention is to provide a filter bag where the thread has the same length as the bag in its use layout with the pockets or lobes opened or distended.

Another aim is that of providing a filter bag which is of easy manufacture by a continuous automatic method which is economical considering the practical facility of packaging it in lots for sale, but above all because of the double use and the greater utilization that it permits of the product contained and intended for infusion.

These and further aims that will become apparent later in the description are all attainable with the filter bag according to the invention for infusion products such as tea, camomile and similar. The filter bag is characterized in that it is a heat weldable filter paper structure with multiple pockets or lobes, either successive or in series, each containing a corresponding fraction a dose or unit quantity of infusion product such that it can assume two positions of use: one is in the flat form for packaging in lots for salt with said pockets or lobes, successive or in series, superimposed or back-to-back (face-to-face) with the folding of a pocket or lobe either above or next to the other; the other is in a form with the pockets or lobes opened out or distended, one following the other or in series, following the pick-up and pulling action of the relevant tag (label) ending in the thread for handling the filter bag at the time of use.

According to another characteristic of the filter bag as above said thread has the same length as that of the bag in its position of use with the pockets or lobes opened out. The thread is fixed at the opposing ends of said bag through a piece of heat weldable material together with the standard non heat weldable paper tag (label) next to one of said opposing ends, and is wound longitudinally on the outside of the bag when said pockets or lobes are in their position of use and for packaging in lots for sale with the lobes folded back-to-back (face-to-face).

In practice such a filter bag is manufactured with the method according to this invention. Manufacture begins from a shaped tube, flattened continuously, form a web of head weldable filter paper, and characterized in that on this tube moving and being flattened continuously operations take place that feed equidistant fractions of infusion product dose, folding and longitudinal heat welding and transversal heat welding, at intervals, in order to enclose said fractions of dose with each transversal heat welding operation so that each of said transversal heat welding operations makes at the same time both the bottom and the seal for the pockets or lobes in succession; also the feeding of tags (labels) at intervals from the mean transversal line of the alternate transversal heat welds and longitudinally of a continuous thread in contact with the external surface of the shaped flattened tube and of a heat weldable piece of material through said alternate transversal heat welds partially against said tags (labels); also the heat welding of said heat weldable pieces so as to connect said thread to said tags (labels) and the thread to said tube through said alternate transversal heat welds; also the cutting of said tube so structured along the mean transversal line of said transversal alternate heat welds into sections comprising at least two successive pockets or lobes; also the folding of said sections with at least two pockets or lobes around the corresponding intermediate transversal heat weld so as to superimpose or set up back-to-back; said lobes and also the joining by heat welding the respective resulting transversal end edges side by side with the help of of the corresponding piece of heat weldable piece of material.

Further features and advantages of the filter bag and the method for its production according to the present invention will become more evident in the detailed description that follows of one of their preferred practical embodiments given purely by way of example and therefore not exhaustive, with reference to the appended drawings wherein:

BRIEF DESCRIPTION OF THE DRAWINGS

FIG. 1 being a perspective view of the initial section of the web seen from above and FIGS. 1A, 1B and 1C being the intermediate and end sections, always in perspective, but from below;

As said earlier, the filter bag for infusion products made of heat weldable filter paper according to the present invention, shown in its entirety (1) is composed of a tubular essentially flat structure with median longitudinal weld (2) on a surface, by way of multiple pockets or lobes, either in succession or in series (3) and (4)—in particular cf. FIGS. 3, 4 and 5—each of which can contain a corresponding fraction (5) and (6) of dose or unit quantity of infusion product, for example tea grindings.

Figure 1:
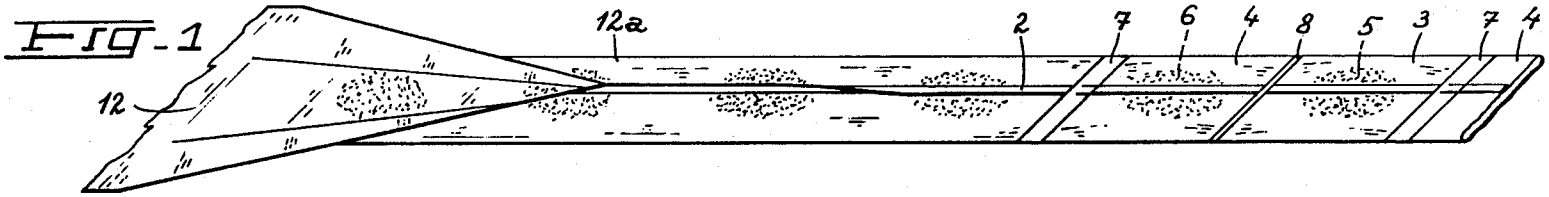
FIGS. 1, 1A, 1A and 1C show in succession the stages through which the filter bag according to the invention is obtained from a web of filter paper.
Figure 1A:
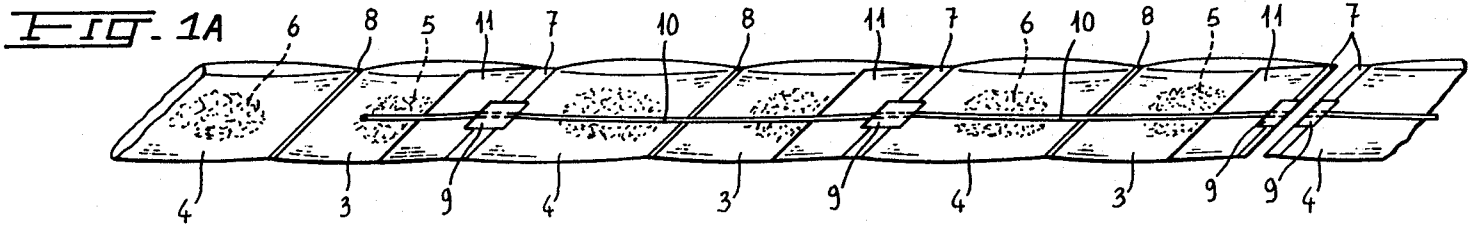
Figure 2:
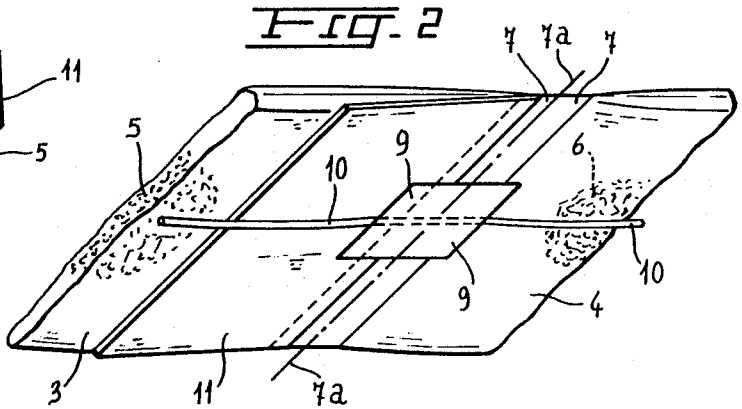
FIG. 2 shows, perspectively and from below, an enlarged detail.

Said container pockets (3) and (4) are defined by alternate transversal heat welds (7) and an intermediate one (8).

Substantially, along the transversal heat welds (7), as will be seen later, a heat weldable piece of material (9) is heat welded, known in the trade under the Registered Trade Mark "MYLAR", to the two ends of a thread (10), one of which also terminates in a non heat weldable paper tag (label) (11).

Figure 3:
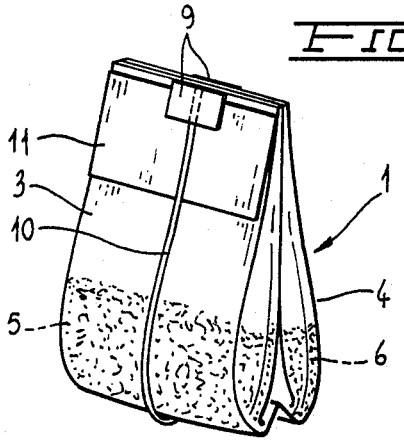
FIGS. 3 and 4 show perspectively the filter bag in its positions of use, one of which for the packaging in lots for sale.
Figure 4:
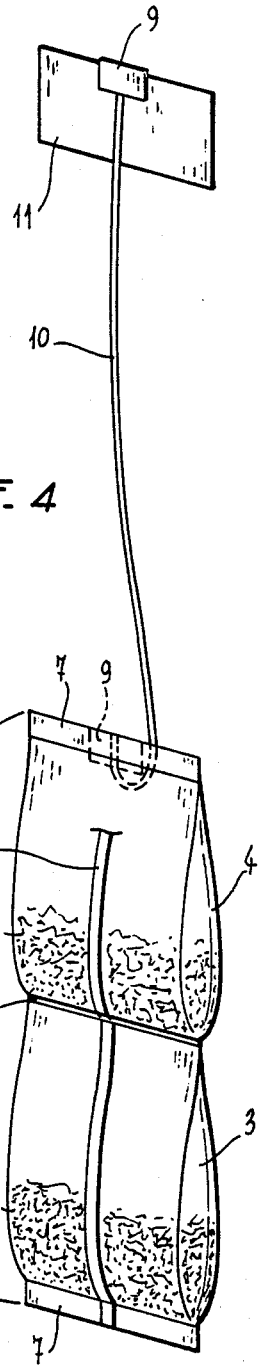
Figure 5:
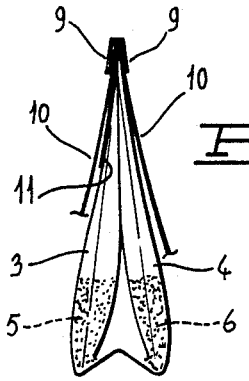
FIG. 5 shows the same filter bag from the side in the said position of use and packaging in lots for sale.
Figure 6:
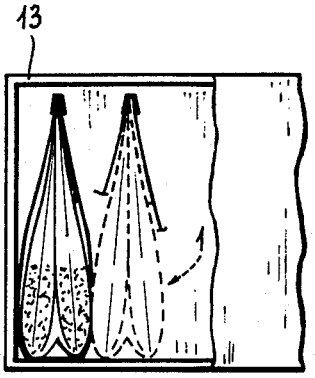
FIG. 6 shows a boxed pack of such filter bags ready for sale.

In practice, such a bag structure (1) can assume, as envisaged in effect by the invention, two positions of use: one in the flattened form (cf. FIGS. 3, 5 and 6) for packaging in lots in boxes (13) (FIG. 6) for sale, with said pockets or lobes (3) and (4) in succession flattened and superimposed or back-to-back by folding pocket (3) over pocket (4) along the intermediate weld (8); the other, in an opened out or distended position of the pockets or lobes, one after the other or in series; in the manner explained later (cf. FIG. 4).

In the position of use of bag (1) as per FIG. 3, thread (10) connecting tag (label) (11) to the bag in the manner seen later, is wound longitudinally externally to the bag itself and the manner of use will also be seen later.

Such a filter bag (1) is obtained in practice with the method described in the present invention starting from a tube (12*a*) with a continuously flattened shape from a web of heat weldable paper web (12) by carrying out in succession on this tube that is being flattened (12*a*) in continuous movement the feeding of equidistant fractions of infusion products (5) and (6) and folding and longitudinal heat welding operations (2) (Cf. FIG. 1).

With the advancing of the flattened tube (12*a*) continuously, it undergoes transverse heat welding operations (7), at intervals, with the transversal heat welds (8) having a lesser width, so as to enclose said fractions of dose on each of said transversal heat welds (7) and (8) so that each of them produces at the same time the bottom and the seal for the contiguously successive pockets or lobes (3) and (4). Always with the progressing of said tube (12*a*), thus heat welded to contiguous pockets or lobes (3) and (4) the following takes place in contact with tube (12*a*) and distant from the median transverse line (7*a*) of the alternate transverse heat welds (7): feeding of successive tags (labels) (11), laying continuously thread (10) in the median longitudinal position and then, partly above said tags (labels (11) a corresponding piece (9) of the above said heat weldable material known commercially under the Trade Mark "MYLAR", therefore heat welding in succession said pieces (9) so as to connect said thread (10) to said tags (labels) (11) and the thread itself (10) to tube (12*a*) through said transverse heat welds (7).

Figure 1C:
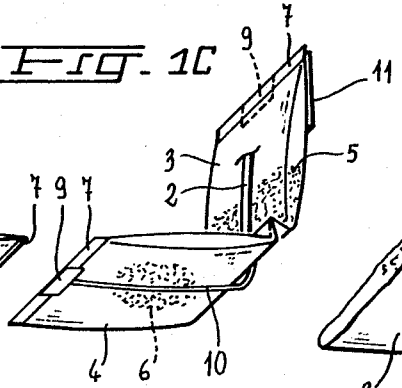
Figure 1B:
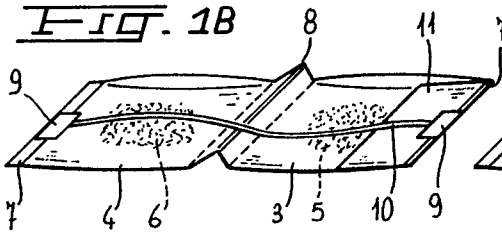

At this juncture tube (12*a*) so structured and transversely heat welded along the median transversal lines (7*a*) of transversal heat welds (7) is cut, dividing in two parts the respective pieces (9) and in sections said tube (12*a*) that include at least two successive pockets or lobes (3) and (4) and folding said sections with at least two pockets or lobes (3) and (4) with a prior inverted V fold along the relevant intermediate transversal heat weld (8) so as to superimpose or set up back to back said lobes (3) and (4) (cf. FIG. 1C).

Lastly, by heat welding the respective resulting transversal end edges, side by side, by means of the gluing material of the corresponding of heat weldable pieces of material (9) (cf. FIG. 3), said edges are joined.

As regards the amount of gluing material released by the heat weldable pieces of material (9), which in turn is a function of the intensity of the heat welding operation, in practice we have found that it is possible to achieve the two positions of use of the bag following the pick-up and pulling action of tag (label) (11) by simply detaching thread (10) with the relevant tag (label) (11) from lobe (3), leaving the latter's end edge attached to the end edge of lobe (4) from the layout of the bag for packaging in lots for sale (FIG. 3), or even detaching also said end edge of lobe (3) from that of lobe (4) so as to enable the former to open out in respect of the latter, as shown in FIG. 4.

In practice we have found that, with a filter bag so constructed, with lobes in series folded either superimposed or back-to-back with each other so as to assume two positions of use following the simple action of pick-up and tear by pulling the corresponding tag (label) for handling the filter bag at the moment of use, it is possible to obtain a greater utilization and therefore a better yield from the infusion product grindings, thus achieving the aims we had set.

The description of the filter bag and the method for producing it, with reference to the appended drawings, obviously is given by way of example only and therefore it is evident that all modifications and variants suggested by experience and practice can be made, always provided that the filter bag can assume two different positions of use: one, in the same form of packaging in lots for lots, with container lobes folded superimposed or back to back to each other and opened out one after the other following a simple pick-up and tear due to the pulling action exerted on the corresponding tag (label) for the handling of the filter bag at the moment of use, and in any case always within the precepts of the following claims.

I claim:

1. A filter bag for an infusible product, comprising:

an elongated flattened tube of heat-weldable filter paper formed at opposite ends with respective end heat seals closing said tube, and an intermediate heat seal forming discrete lobes in the tube and closing off respective compartments in said tube, each compartment defined between one of said end seals and said intermediate seal, said compartments each containing a measured quantity of said infusible product;

means at said intermediate seal defining two parallel folds forming a gusset between them, said gusset being located in said tube between said compartments whereby each of said compartments is disposed in a respective lobe of said tube and said lobes have:

a packaged position in which one of said lobes overlies and is juxtaposed with the other of said lobes and inner faces of said end seals are juxtaposed with one another and releasably joined together by a weld, and a use position wherein said lobes are substantially coplanar and an upper one of said lobes is disposed above a lower one of said lobes, and said lower one of said lobes is suspended from said upper one of said lobes at said gusset;

a thread for manipulating said lobes and extending around said lobes in said packaged position;

a heat weldable piece of material welded to one end of said thread and to an outer face of the end seal of said upper one of said lobes affixing said one end of said thread to said end seal of said upper one of said lobes;

a tag affixed to another end of said thread; and another heat weldable piece of material affixing said tag to said other end of said thread and releasably affixing said other end of said thread to an outer face of said end seal of said lower one of said lobes, such that upon detachment of said end seals from one another, said tag and said thread can suspend said lobes in said use position from the end seal of said upper lobe.

* * * * *